United States Patent [19]

Tomarin

[11] Patent Number: 4,497,853

[45] Date of Patent: Feb. 5, 1985

[54] SYNTHETIC TURF CARPET GAME PLAYING SURFACE

[76] Inventor: Seymour A. Tomarin, Box 730, St. Catharines, Ontario, Canada, L2R 6Y6

[21] Appl. No.: 578,727

[22] Filed: Feb. 9, 1984

[51] Int. Cl.[3] ..... A01N 3/00; A41G 1/00

[52] U.S. Cl. ..... 428/17; 428/95; 428/96

[58] Field of Search ..... 428/17, 95, 96

[56] References Cited

FOREIGN PATENT DOCUMENTS 65622 12/1982 European Pat. Off. ..... 428/17

WO80/00649 4/1980 PCT Int'l Appl. ..... 428/17

*Primary Examiner*—Marion E. McCamish

*Attorney, Agent, or Firm*—Cullen, Sloman, Cantor, Grauer, Scott and Rutherford

[57] ABSTRACT

A synthetic pile carpet athletic game playing surface, such as for golf and the like, is formed with a relatively thick, loosely felted, springy fiber mat laid upon a stabilized base, with the pile carpet laid over the mat. The mat is filled with generally coarse, sand granules to provide a shock absorbent, compact resistant layer. The carpet is also filled with a sand granule layer of substantially the height of its pile fibers, and a flexible water barrier sheet is arranged between the carpet and the upper surface of the mat.

8 Claims, 3 Drawing Figures

SYNTHETIC TURF CARPET GAME PLAYING SURFACE

BACKGROUND OF INVENTION

This invention relates to a game playing surface for athletic games, such as golf, football, soccer, tennis and the like, which are formed of synthetic pile carpet. This general type of playing surface is disclosed in my prior U.S. Pat. No. 4,336,286, issued June 22, 1982.

Playing surfaces of this type generally comprise, first, a stabilized base support surface, that is, the ground, which generally is flattened and is provided with suitable drainage means. Second, synthetic pile carpet, generally of the tufted type, which closely resembles natural grass, is laid upon the stabilized base and forms the exposed surface of the game playing field. The pile carpet is filled with a layer of sand-like granules which substantially cover the fibers up to or close to their upper free ends.

This type of playing surface is generally usable for indoor or outdoor games that are played upon natural grass surfaces, as for example, golf, football, soccer, tennis, etc.

Because the playing surface of the type described above, is relatively hard, a ball hitting it tends to roll further than a natural surface. For example, in the case of a golf green, the first bounce of a hard-hit ball striking the surface will be similar to that of a natural grass golf green surface, but then the ball will roll much further. In some instances, to make the surface softer or more resilient for the purpose of a more natural feel underfoot, resilient foam plastic padding has been placed beneath the carpet. However, the padding tends to bottom out upon high ball impact and therefore, the ball does not rebound in the same manner as upon a natural grass surface.

Consequently, the invention herein relates to an improved playing surface which tends to produce the advantages of a surface which has no foam pad underlay as well as the advantages of a more resilient surface. For example, for golf purposes, the improved surface provides a first bounce similar to a natural golf green, while still providing an acceptable distance roll, and also a soft feeling surface. The improved playing field surface is particularly useful for golf greens, tending to more closely simulate a natural grass golf green effect upon the ball shot at different velocities and angles. However, the surface is likewise useful for other athletic games.

SUMMARY OF INVENTION

The invention contemplates forming an athletic game playing surface of a synthetic pile carpet laid upon a stabilized support base, such as the ground, with a relatively thick, loosely felted, fiber mat made of springy, relatively coarse fibers, arranged between the base and the carpet. The mat is in-filled with a filling of relatively coarse, sand-like granules so that the mat provides an internal, shock absorbent, relatively resilient or compact resistant layer. The carpet is likewise in-filled with a coating of sand-like granules covering the carpet primary base sheet near to the full height of the fibers, leaving their upper ends exposed.

Preferably, a water impervious flexible sheet is placed between the carpet base and the mat for diverting water to the sides of the playing surface or to appropriate drainage places, while spreading the load of impacts upon the mat and protecting and preserving the structural integrity of the mat.

For certain game playing purposes, a resilient underlay pad, such as a resilient, relatively thick foam plastic pad, may be located beneath the carpet and upon the flexible barrier sheet, and may be fastened, if desired, to the bottom of the carpet.

The above described playing surface, generally feels soft underfoot, that is, more nearly like a natural grass playing field. In addition, it tends to resist compacting, but absorbs relatively high impacts, such as the high impact of a hard hit ball and the like. Moreover, the surface tends to more closely simulate a natural grass surface in that it generally obviates the bottoming out effect found in synthetic carpet playing surfaces, particularly for golf and other ball bouncing type of games, while producing a first bounce effect similar to a harder surface and a roll distance effect similar to padded carpets.

Another object of this invention is to provide an athletic game playing field surface, particularly useful for golf greens, but also for other athletic games, which simulates a natural grass playing field, and which is of simple and inexpensive construction and is easy to maintain and repair.

These and other objects and advantages of this invention will become apparent upon reading the following description, of which the attached drawings form a part.

DETAILED DESCRIPTION

Figure 1:
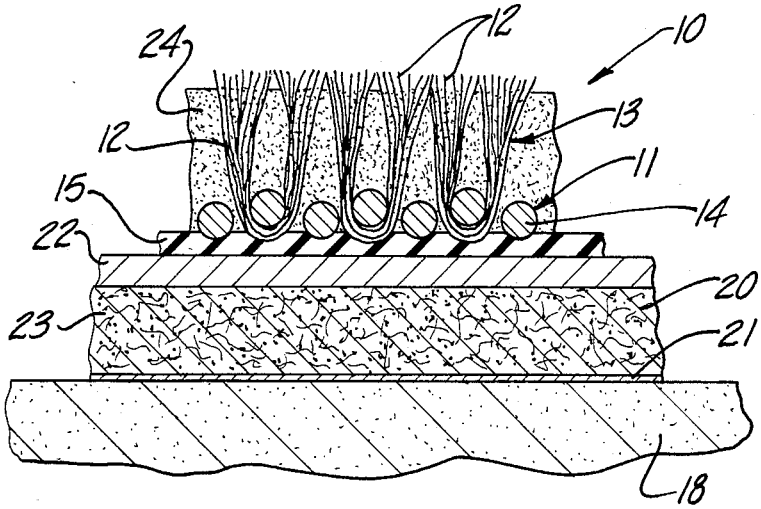
FIG. 1 is a schematic, cross-sectional, elevational view of a fragment of the athletic game playing surface herein.

FIG. 1 schematically illustrates a cross-sectional fragment of an athletic game playing surface 10, such as a section of a golf green. The surface, in general, is formed of a synthetic, pile carpet 11 which may be made of numerous tufts 12. These tufts typically are formed of U-bent plastic strands 13, such as polypropylene or the like plastic fibers tufted into a woven, carpet primary backing sheet 14.

The type of construction of the carpet may vary, there being a number of commercially available forms usable, but in general an example of such carpeting is one having a woven, polypropylene or nylon cloth primary backing sheet with the tufts formed of individual strands or fibers made of commercially, available stretch oriented polypropylene or the like. The fiber tufts may vary in size and thickness, as for example, being on the order of about 5,700 to 10,000 denier with each fiber being considerably wider than thick. An example of sizes of such fiber would be one and one-half to 2.6 mils thick and roughly one-sixteenth of an inch in width to form a paper thin, narrow strip, and of a height of between one-half to two and one-half inches. These strips are resilient to a considerable degree because of the nature of synthetic plastic. Thus, they tend to shred or split longitudinally at their ends so as to tangle and intertwine to form a dense grass-like network.

The tuft strands are closely arranged upon the backing sheet so that their bights are snugly held by the fibers of the woven primary backing. By way of example, positioning the tufts at roughly one-eighth of an inch apart in one direction and roughly a quarter of an inch apart in the opposite direction, densely packs them together to form the dense network or mass which simulates natural grass. An example of such a carpet formed in this manner is one that is roughly between 24–55 ounces per square yard in weight.

A secondary backing sheet 15 is commonly used with this form of carpet. This secondary backing sheet may be made of a rubber-like material, such as latex or commercially available, rubber-like urethane, or vinyl which is coated or bonded to the exposed lower surface of the primary, woven backing sheet. The purpose of the secondary sheet is for strengthening the carpet, preventing unraveling of the primary sheet and detaching of the tufts, etc. Such secondary backing sheet may be relatively thin, such as on the order of 1/32 of an inch, more or less.

The carpet is laid over a stabilized support base 18, which may be the ground or earth in a particular area or may be a prepared surface, such as a suitable sand or gravel surface. Where the surface is relatively large, as in many types of athletic fields, suitable drainage has to be provided, such as drainage pipes beneath the exposed surface of the ground, and the like. The particular form of stabilized base surface or ground is not relevant to this invention, except that a suitable support surface must be provided.

A relatively thick mat 20 formed of loosely felted, springy fibers is positioned upon the stabilized support base surface. This mat may be on the order of between about one-quarter to three inches in thickness. The specific thickness is not critical but may be varied depending upon the material of which the mat is made and the requirements of a particular game. Preferably, the mat is formed of coconut hairs or fibers which seem to have a suitable degree of coarseness, springiness or resilience, weather resistance and durability for this purpose. However, similar characteristic, randomly bent plastic fibers, which may be bonded together where the fibers contact one another, may be used to form the loosely felted mat.

Significantly, the mat, being non-compacted, i.e., loosely felted of relatively long fibers or hairs, is honeycombed with spaces or interstices between the fibers. The mat is very compressible with a strong tendency to return, resiliently, to its initial thickness and form.

Figure 2:
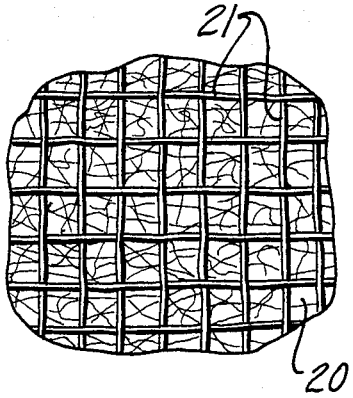
FIG. 2 is a fragmentary, bottom view of the mat, showing a mesh cloth applied upon the lower surface of the mat.

An open mesh cloth 21 or the like (FIG. 2) is secured, as by bonding with adhesive or by other forms of known bonding, to the lower surface of the mat. This cloth preserves the structural integrity and protects the mat against damage. In addition, its fibers form a slightly roughened surface to lock against the ground 18. The open mesh cloth may be made of any suitable plastic or natural material which is weather resistant and durable.

A flexible, water barrier pad 22 is positioned upon the upper surface of the mat. This pad is formed of a flexible sheet, which preferably may be of a non-woven fabric made of plastic fibers which are selected from a type having the ability to withstand the weather conditions, impacts, and the like encountered in this type of playing surface. Such a water barrier pad may also be used beneath the mat to cover the support base 18 if the base is compacted earth material or granular and therefore, additional protection is desirable.

Although the barrier sheet or pad may be made of a variety of commercially available materials which are flexible and, in general, are water impervious, one suitable sheet is a non-woven fabric produced by Phillips Fibers Corporation and identified by the trademark "Supac" of the Phillips Petroleum Company, with the trade designation of "8P Nonwoven Fabric". This particular material, has a nominal fabric weight of 8.0 oz. per square yard, and a fabric thickness of 96 mils.

The manufacturer specifies that its tensile properties, in accordance with ASTM D-1682, are:

Ultimate strength, warp direction, lbs., wet: 230
Ultimate strength, filling direction, lbs., wet: 300
Elongation at break, percent, wet: 80
Toughness (product of strength and elongation—averaged): 18,000
Ultimate strength after abrasion (Taber abrader, CSI-17 wheel, ASTM D-1175): 209
Trapezoidal tear, lbs. (ASTM D-2263): 85
Puncture strength (ASTM D-751 Modified): 150
Mullen Burst, psi (ASTM D-751): 400+

The manufacturer further specifies as to permeability that:

Air permeability ($ft.^3/min./ft.^2$) at 0.5" water head (ASTM D-737): 291
Water permeability, coefficient of, cm./sec., C of E, EM 1110-2-1906 (Modified): $8.0\times10^{-2}$
Equivalent Opening Size (EOS), C of E, CW-02215 (Modified): 100

As stated above, this particular fabric appears to be well suited for the purpose. However, other commercially available suitable fabrics, may be used in its place for the intended athletic playing field surface, depending upon the specifications of the surface for the particular game and location.

The mat is preferably in-filled with a filling of coarse silica sand granules which fill the spaces or interstices between the fibers making up the mat. The filling 23 is preferably of rounded, large granular size particles. While the sizes of the granular material may vary, an example of a suitable mixture is as follows:

#10 U.S. Sieve: 1%
#16 U.S. Sieve: 37%
#20 U.S. Sieve: 37%
#30 U.S. Sieve: 21%
#40 U.S. Sieve: 4%

At times it may desirable to smooth the upper surface of the mat filling and this can be done with a top or uppermost dressing more nearly in the range of the 16–40 sieve sizes, for example:

#16: 23%
#20: 29%
#30: 23%
#40: 16%
#50: 8%
#70: 1%

This mixture of sand may be varied considerably, with the objective being to provide a relatively large granular size so that the pad will not compact under impact and thus, will maintain its shock absorbance. Hence, the particular size grains indicated above, are useful for a good golf green surface, but may be varied depending upon the particular need for a specific playing field, as well as the commercial availability of the material.

A similar filling 24 is provided in the carpet. That is, the pile carpet is filled with a coating or layer of sand granules, which may be in the range of 10–70 mesh, roughly, more or less. Again, the particular size of the sand filling may be varied depending upon the purpose, conditions and location, availability, etc. Preferably, round sand granules are used. However, for some game purposes, crumb rubber or the like resilient particles may be used with or without the sand as the filling.

The composite surface described above, will closely simulate a natural grass playing field surface, particularly in the case of golf greens and the like with respect to ball bounce and ball holding ability. Moreover, this surface is relatively easy to construct and relatively inexpensive in cost. Likewise, the maintenance is simplified and repairs to damaged portions of the surface can be easily made.

For some purposes, it is desirable to also include a more resilient feel or quality to the surface. Hence, for these particular uses, the modification of FIG. 3, includes a relatively thick, resilient foam underlay or layer 25 between the carpet secondary sheet and above the barrier sheet. A suitable urethane foam material, which is commercially available in various grades and resiliencies, can be utilized depending upon the requirements of the particular location and game. The foam underlay 25 can also be positioned under the sand filled mat, that is, between the mat and the base (not illustrated).

Figure 3:
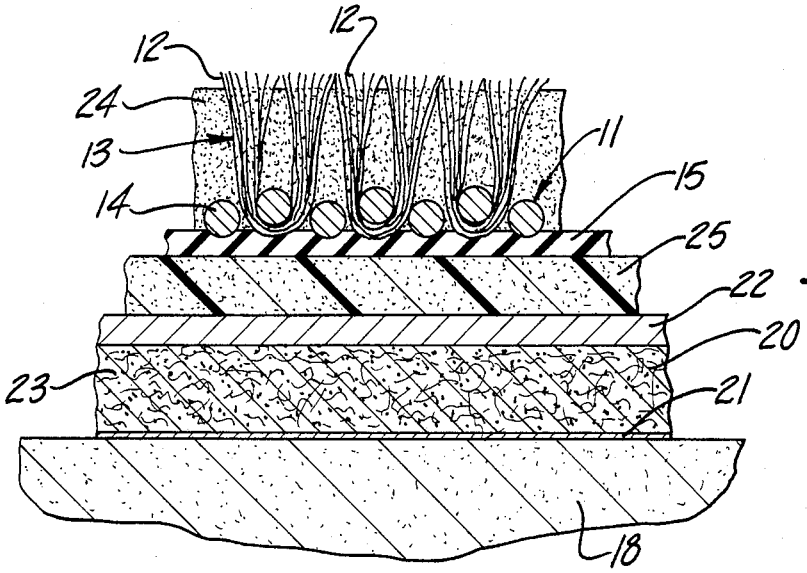
FIG. 3 is a view similar to FIG. 1, but showing a modification.

Otherwise, as indicated in FIG. 3, the construction and the elements are the same as that described above in connection with the embodiment of FIG. 1.

Having fully described an operative embodiment of this invention, I now claim:

1. A game playing surface, such as for golf, formed of a synthetic pile carpet positioned upon a stabilized support base surface, comprising:

a relatively thick mat laid upon said support base surface, with said mat being formed of loosely felted, somewhat springy, coarse coconut hair fibers, so that the mat resiliently resists compacting;

a filling of generally coarse sand granules which substantially fill the interstices between the mat fibers, wherein the filled mat forms a shock absorbent, compact resistant layer over the support base surface;

a pile carpet laid over said mat, with the carpet formed of generally equal length, upwardly extending, synthetic fibers fastened at their lower ends to a carpet primary base sheet, so that the fibers give a substantially grass-like appearance;

a uniform thickness coating of sand-like granules covering the carpet primary base sheet and covering the fibers for a substantial portion of their heights, such as close to their upper free ends, and with the coating substantially filling the interstices between the fibers.

2. A game playing surface as defined in claim 1, and including a water barrier pad arranged between the mat and the carpet;

said pad being formed of a non-woven, flexible sheet which is substantially water impervious for diverting water from the mat.

3. A game playing surface as defined in claim 1, and including a rubber-like, resilient backing sheet bonded to the lower surface of the carpet primary backing sheet.

4. A game playing surface as defined in claim 3, and including a water barrier pad arranged between the mat and the carpet, with said pad being formed of a flexible sheet which is substantially water impervious for diverting water from the mat.

5. A game playing surface as defined in claim 4, and including a mesh-like flexible sheet fastened to the lower surface of the mat for engagement with the support base surface.

6. A game playing surface as defined in claim 1, and including an open mesh, flexible sheet fastened to the lower surface of the mat for frictional engagement with the support base surface.

7. A game playing surface as defined in claim 1, and including a relatively thick, resilient foam plastic layer interposed between the carpet and the mat.

8. A game playing surface as defined in claim 1, and including a rubber-like, resilient backing sheet bonded to the lower surface of the carpet primary backing sheet;

and a relatively thick, resilient foam plastic layer arranged between the carpet and the mat.

* * * * *